US005741146A

United States Patent [19]

Henry et al.

[11] Patent Number: 5,741,146

[45] Date of Patent: Apr. 21, 1998

[54] COAXIAL SWITCH

[75] Inventors: Randall Robert Henry, Harrisburg; Michael John Phillips, Camp Hill, both of Pa.

[73] Assignee: The Whitaker Corporation, Wilmington, Del.

[21] Appl. No.: 740,460

[22] Filed: Oct. 29, 1996

[51] Int. Cl.[6] ..... H01R 29/00

[52] U.S. Cl. ..... 439/188; 439/944

[58] Field of Search ..... 439/188, 944; 200/51.1, 51.12

[56] References Cited

U.S. PATENT DOCUMENTS 4,633,048 12/1986 Komatsu ..... 200/51.1
4,778,240 10/1988 Komatsu ..... 350/96.2
5,007,851 4/1991 Matsumoto ..... 439/188
5,239,145 8/1993 Kusakabe ..... 200/51.1
5,267,871 12/1993 Flanagan ..... 439/944
5,453,019 9/1995 Garver et al. ..... 439/188

*Primary Examiner*—Gary F. Paumen
*Assistant Examiner*—T. C. Patel
*Attorney, Agent, or Firm*—Robert Kapalka

[57] ABSTRACT

A switch comprises a housing which holds first and second contacts. The first contact has a pair of first contact arms which are spaced-apart on opposite sides of a pin-receiving cavity. The second contact has a resilient contact arm which extends into the pin-receiving cavity and includes laterally extending wings which are normally engaged with respective ones of the first contact arms. The resilient contact arm is arranged to be deflected by a pin which is inserted into the cavity, wherein the second contact becomes disengaged from the first contact when the pin is installed in the cavity.

9 Claims, 5 Drawing Sheets

COAXIAL SWITCH

FIELD OF THE INVENTION

The invention relates to a coaxial switch having a pair of normally closed contacts which are opened upon receipt of a pin between the contacts.

BACKGROUND OF THE INVENTION

U.S. Pat. No. 5,453,019 discloses a coaxial switch which is suitable for switching between internal and external antennas in a cellular phone. The switch includes a pair of normally closed contacts which are connected in-line with an internal antenna of the phone. When the phone is to be used in a vehicle, it is desirable to connect the phone with an external antenna which is mounted on the vehicle. A cable from the external antenna is routed to a base unit in the vehicle and is terminated at a coaxial connector on the base unit. When the phone is plugged into the base unit, a pin of the coaxial connector enters the switch and engages one of the contacts, thereby coupling the external antenna to the phone circuitry. Concurrently, a dielectric material on the pin engages the other contact which is connected to the internal antenna, thereby interrupting the link between the internal antenna and the phone circuitry.

The constant trend toward miniaturization makes it desirable to reduce the size of electronic components in a cellular phone. The present invention is directed to reducing the size of a coaxial switch which may be used in a cellular phone.

SUMMARY OF THE INVENTION

The invention is a switch comprising:

- a housing having a cavity for receiving a pin of a mating connector, the cavity being dimensioned to accommodate a pin envelope which is defined as a volume occupied by the pin when the pin is installed in the cavity;
- a first contact held by the housing and arranged to be clear of the pin envelope; and
- a second contact held by the housing, the second contact having a resilient contact arm which is normally engaged with the first contact, the resilient contact arm including a portion disposed in the pin envelope and arranged to be deflected by the pin, wherein the second contact becomes disengaged from the first contact when the pin is installed in the cavity.

According to one embodiment, the first contact includes a pair of first contact arms which straddle the pin envelope, and the second contact includes wing portions which extend laterally from the resilient contact arm and are engaged with the pair of first contact arms.

BRIEF DESCRIPTION OF THE DRAWINGS

The invention will be described by way of example with reference to the accompanying drawings wherein.

DETAILED DESCRIPTION OF THE PREFERRED EMBODIMENT

Figure 1:
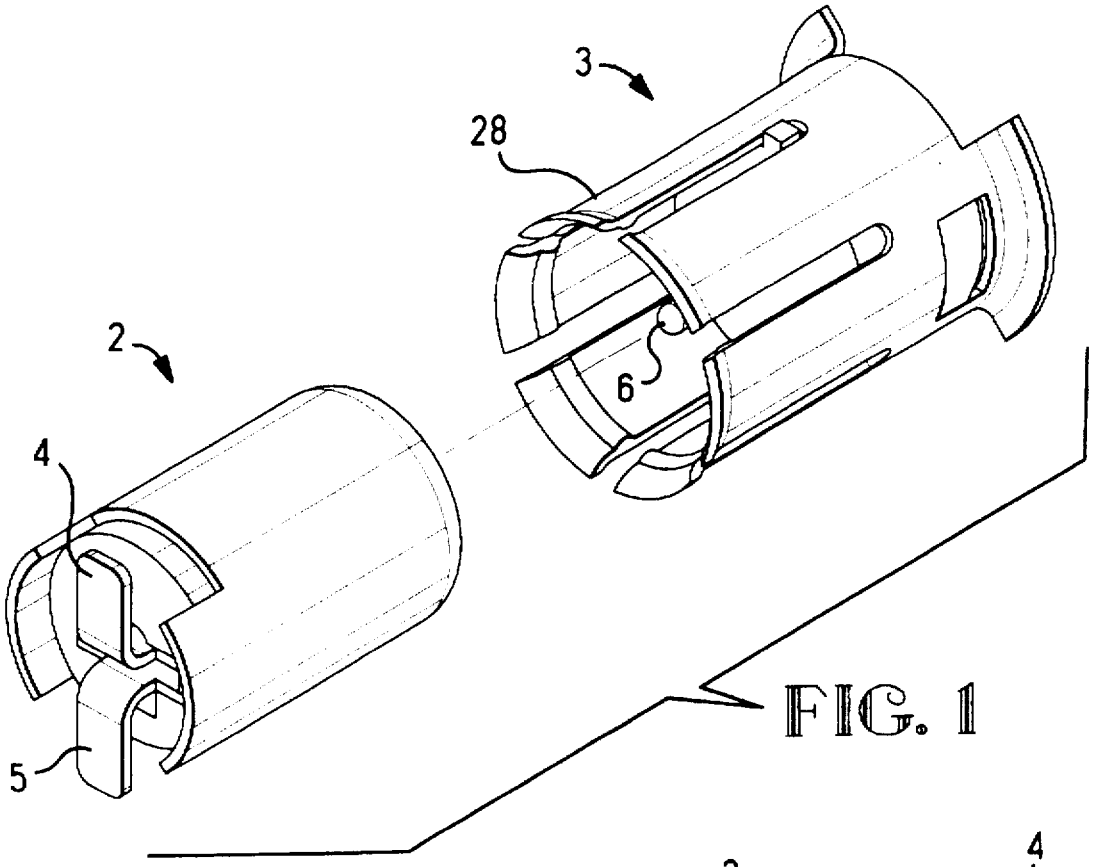
FIG. 1 is an isometric view of a connector assembly comprising a coaxial switch and a mating connector.
Figure 2:
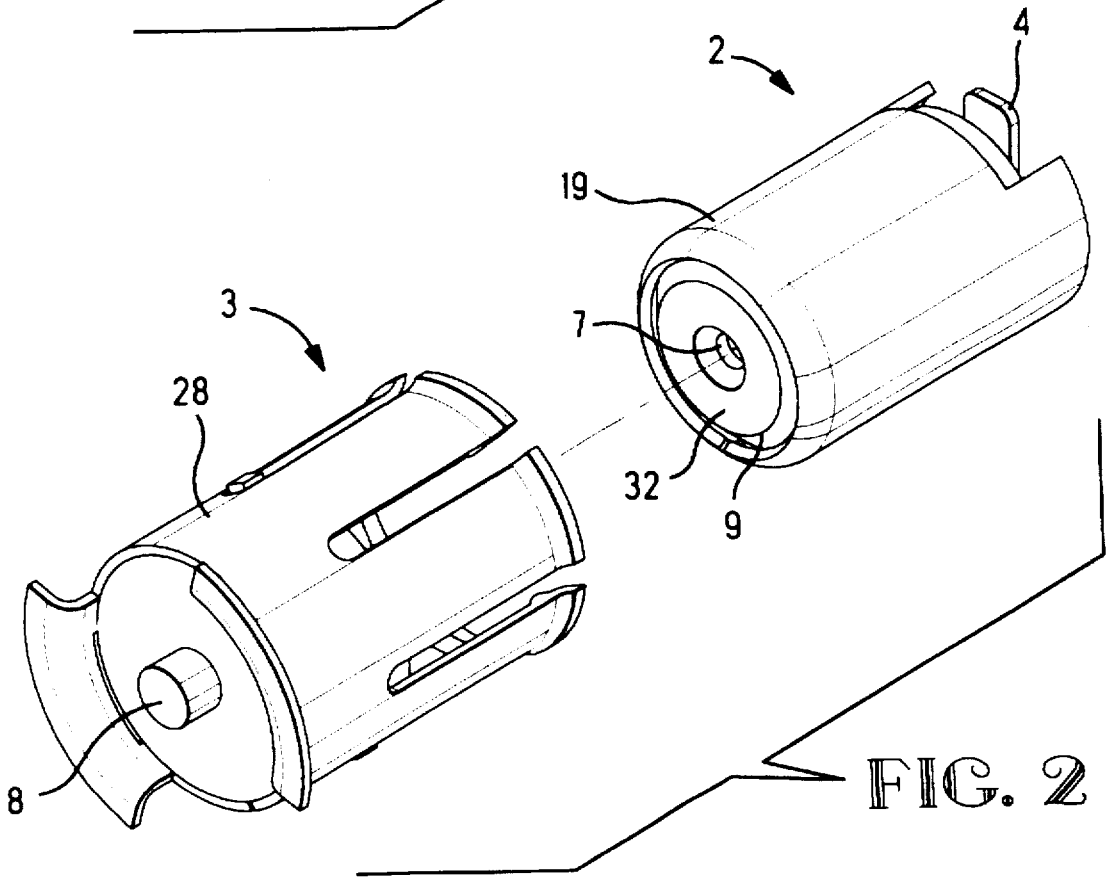
FIG. 2 is an isometric view of the switch and mating connector from a different direction.

There is shown in FIGS. 1 and 2 a connector assembly comprising a coaxial switch 2 and a mating connector 3. The coaxial switch 2 is adapted for use in a cellular phone to connect either an internal or an external antenna to the electronic circuitry of the cellular phone. The switch 2 includes a pair of normally-closed contacts each with a respective foot or lead 4,5 which can be soldered to a circuit path on a circuit board (not shown) in the phone. The lead 4 of one contact can be soldered to a circuit path for the internal antenna, and the lead 5 of the other contact can be soldered to a circuit path for the phone circuitry, thereby linking the internal antenna to the phone circuitry when the contacts are closed, that is, when the phone is decoupled from its base station. The connector 3 is adapted to be mounted on a circuit board in the base station. The connector 3 has a central contact pin 6 which is receivable in a cavity 7 in the switch. The contact pin 6 has a lead 8 which can be coupled to the external antenna by soldering to a circuit path on the circuit board of the base station. When the cellular phone is plugged into the base station, the pin 5 enters the cavity, opens the switch contacts, and couples the external antenna to the cellular phone circuitry.

Figure 3:
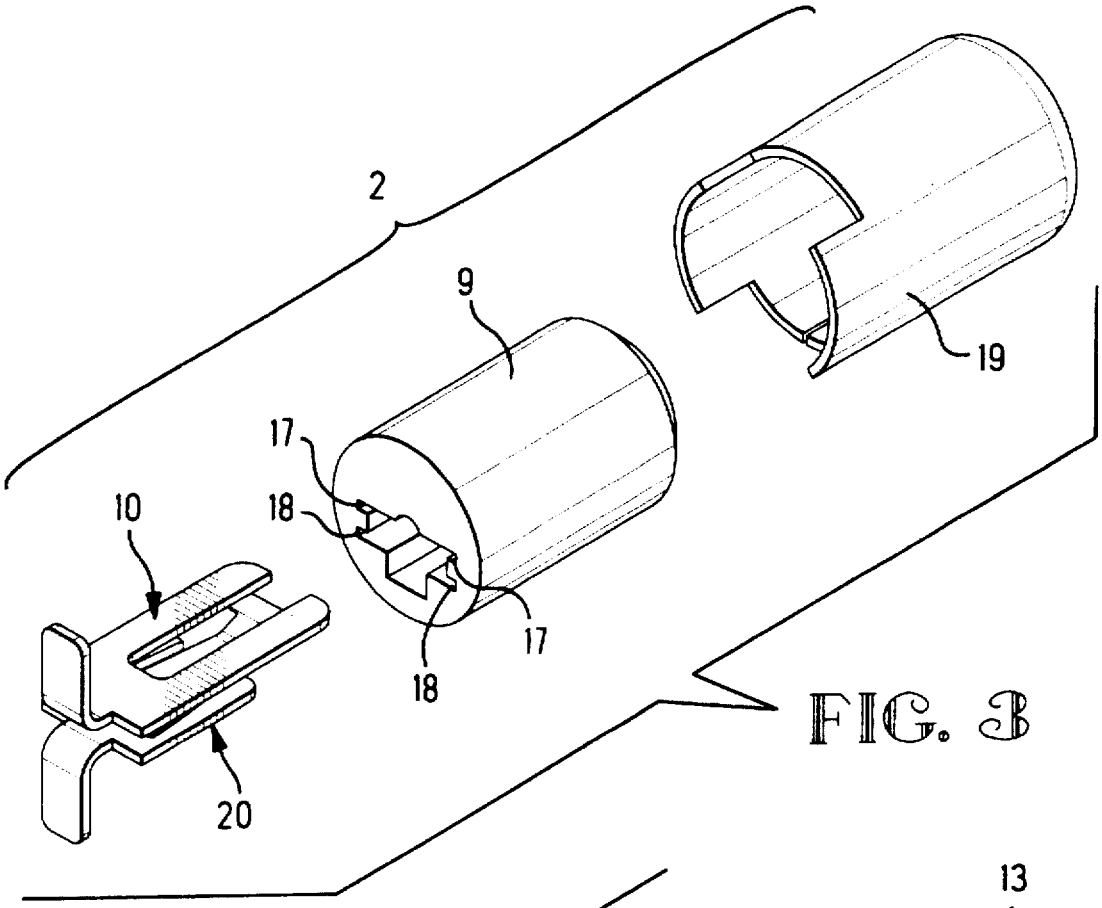
FIG. 3 is an exploded isometric view of the switch.

Components of the coaxial switch 2 are shown in an exploded view in FIG. 3. The switch 2 comprises a dielectric housing 9 which holds first contact 10 and second contact 20. The first contact is held between a pair of opposed grooves 17 in the housing, and the second contact is held between a pair of opposed grooves 18. An electrically conductive shell 19 substantially surrounds the housing and is engageable by a conductive shell 28 of the connector 3 shown in FIG. 1.

Figure 4:
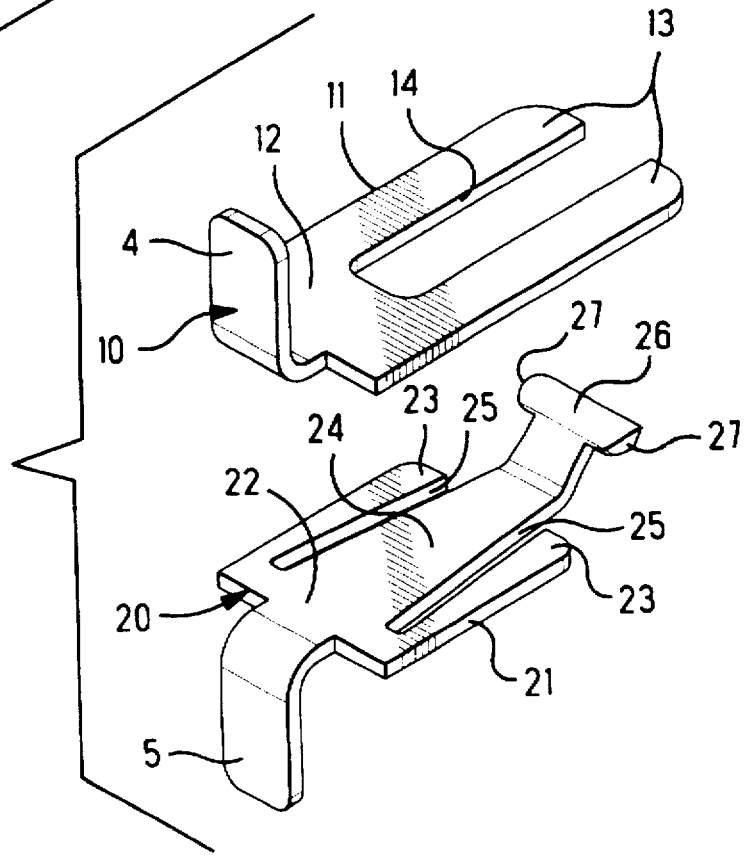
FIG. 4 is an isometric view of contacts used in the switch.

As shown in FIG. 4, the contacts 10 and 20 are preferably blade-type contacts which are stamped and formed from electrically conductive sheet material. The first contact 10 has a planar blade portion 11 including a base 12 and a pair of first contact arms 13 that are aligned in a plane corresponding to the plane of the blade portion 11, and the first contact arms 13 are spaced-apart on opposite sides of a cutout 14 in the blade portion. Outside edge portions of the first contact arms 13 are received in the grooves 17 in the housing 9 with an interference fit so that the first contact 10 is fixed in the housing.

The second contact 20 has a planar blade portion 21 including a base 22 and arms 23 which are received and fixed in the grooves 18 in the housing. Cutouts 25 in the blade portion define a second contact arm 24 which is cantilevered from the base 22. The contact arm 24 extends from the base 22 first in the plane of the blade portion 21, and then extends at an angle from the plane toward the blade portion 11 of the first contact. The contact arm 24 includes an engagement portion 26 having a pair of wings 27 which extend laterally for engagement with the contact arms 13 of the first contact 10. However, it should be understood that only one of the wings 27 is necessary for an electrical connection between the first and second contacts.

Figure 5:
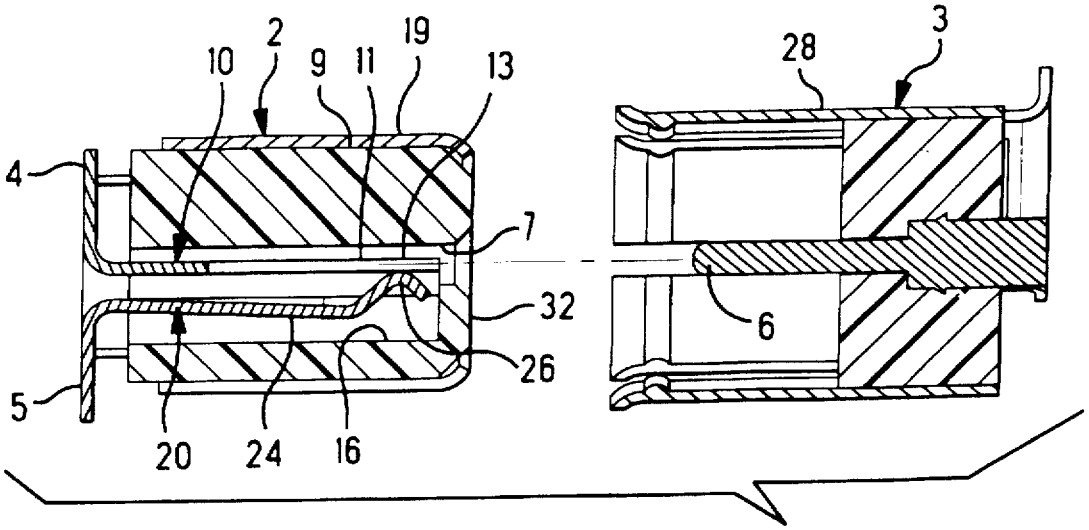
FIG. 5 is a side cross-sectional view through the switch and mating connector in an unmated condition.

As shown in cross-section in FIG. 5, the first and second contacts 10 and 20 are disposed in an internal chamber 16 in the housing 9 of the switch 2. The contacts are normally closed, thereby establishing an electrical path from the internal antenna which is connected to the lead 4 of the first contact, to the phone circuitry which is connected to the lead 5 of the second contact. The cavity 7 extends axially into the housing 9 from a front face 32 and shares a portion of the chamber 16. When the connector 3 is mated with the switch 2, the central contact pin 6 enters the cavity 7 along an insertion path having an axis which coincides with the axis of the cavity 7. The plane of the first contact arms 13 is coincident with the axis of the cavity 7 through the center of the switch 2. The engagement portion 26 of the second contact arm is arranged for engagement and deflection by the pin 6 as the pin enters the cavity. The second contact arm 24 is deflectable in a direction which is perpendicular to the plane of the first contact arms.

Figure 6:
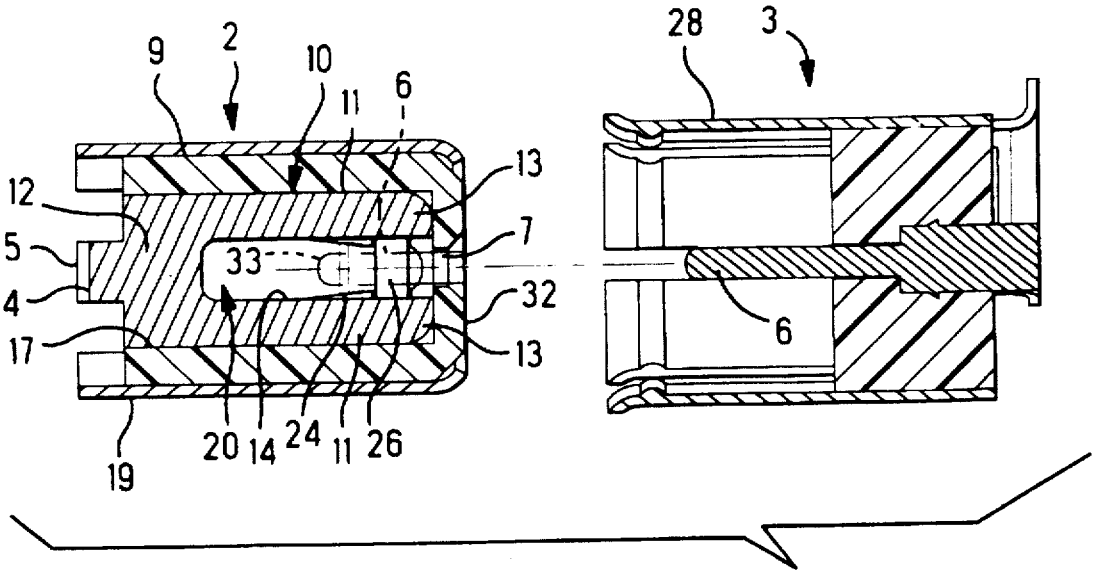
FIG. 6 is a top cross-sectional view through the switch and mating connector in an unmated condition.

With reference to FIG. 6, the cavity 7 accommodates the pin 6 within a pin envelope 33 (shown in phantom) which is defined as the volume which is swept or displaced by the pin 6 when the pin is installed in the cavity. According to the invention, all portions of the first contact 10 are disposed clear of or external to the pin envelope 33. This is accomplished by the cutout 14 which is sized so that the first contact arms 13 straddle the pin envelope 33 on opposite sides thereof.

Figure 7:
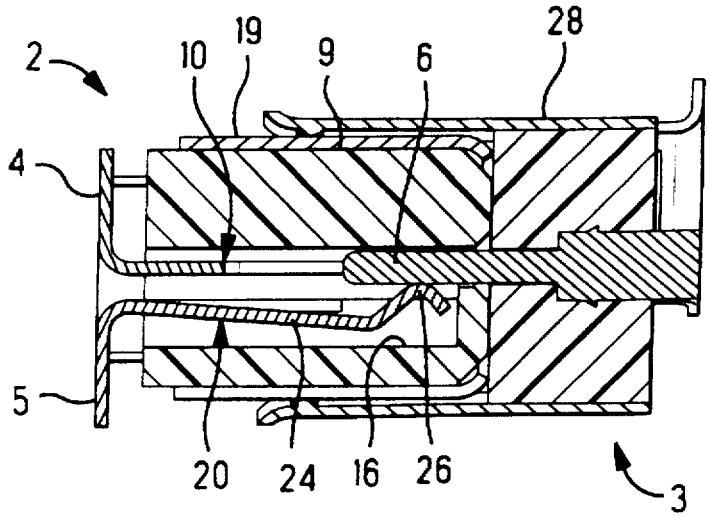
FIG. 7 is a side cross-sectional view through the switch and mating connector in mated condition.
Figure 8:
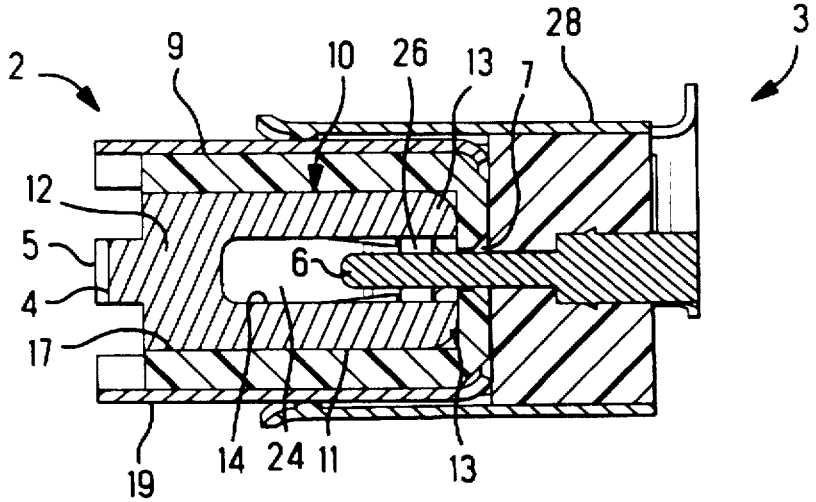
FIG. 8 is a top cross-sectional view through the switch and mating connector in mated condition.

FIGS. 7 and 8 show the connector 3 mated with the coaxial switch 2. As the contact pin 6 of the connector 3 enters the cavity 7, it engages the engagement section 26 and resiliently deflects the contact arm 24, thereby connecting the external antenna with the phone circuitry and interrupting the connection of the internal antenna with the phone circuitry. The pin 6 is received in the cutout 14 between the contact arms 13 of the first contact 10 does not touch any portion of the first contact.

Figure 9:
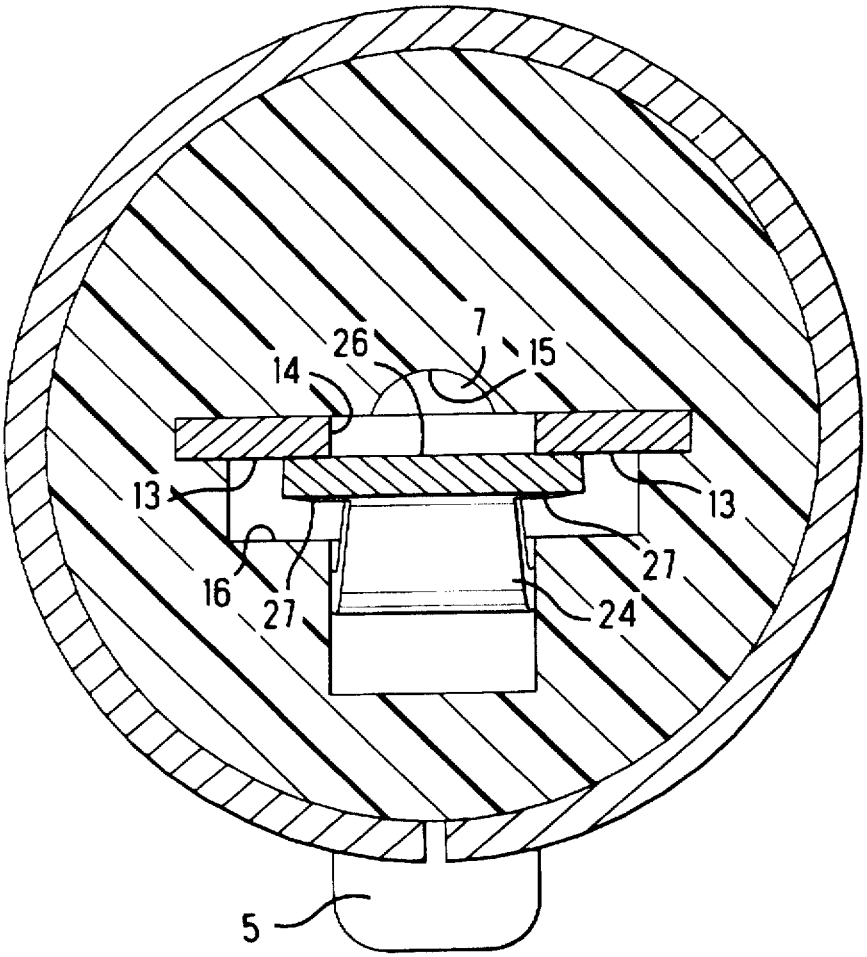
FIG. 9 is a front cross-sectional view through the switch.

With reference to FIG. 9, the cavity 7 has a wall surface 15 which is opposed to the engagement section 26 of the resilient contact arm 24. When the pin of the mating connector enters the cavity 7 and engages the engagement section 26, the resilient contact arm 24 exerts a side load on the pin which tends to deflect the pin toward the surface 15 and may cause the pin to slide along the surface. The surface 15 is shaped in conformance with the exterior surface of the pin and is dimensioned to be closely adjacent to the exterior surface of an undeflected pin. In the present example, the pin 6 has a circular cross-section and the surface 15 has a semi-circular shape. Thus, the surface 15 is shaped to support and guide the pin 6 during insertion and to prevent excessive bending or deflection of the pin.

A switch constructed according to the invention may be reduced in size compared to the prior art switches. The first contact 10 may be centrally disposed in a plane which is coincident with or in close proximity to the insertion axis of the mating connector pin 6, because the cutout 14 ensures that no engagement with the inserted pin will occur. Further, since the contact arm 24 need only be deflected by an amount which is less than the entire diameter of the pin 6, the required deflection of the contact arm is reduced, and thus the length of the contact arm may also be reduced, thereby reducing the overall length of the switch.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A switch comprising:

a housing having a cavity for receiving a pin of a mating connector, the cavity being dimensioned to accommodate a pin envelope which is defined as a volume occupied by the pin when the pin is installed in the cavity;

a first contact held by the housing, the first contact including a pair of first contact arms which are aligned in a plane that is coincident with a pin-receiving axis of the cavity, the pair of first contact arms straddling the pin envelope so as to be clear of the pin envelope; and a second contact held by the housing, the second contact having a resilient contact arm which is normally engaged with the first contact, the resilient contact arm including a portion disposed in the pin envelope and arranged to be deflected by the pin, wherein the second contact becomes disengaged from the first contact when the pin is installed in the cavity.

2. The switch according to claim 1, wherein the second contact includes wing portions which extend laterally from the resilient contact arm and are engaged with the pair of first contact arms.

3. The switch according to claim 1, wherein the first contact is made from sheet material, and the pair of first contact arms are defined by portions of the sheet material on opposite sides of a cutout.

4. The switch according to claim 1, wherein the resilient contact arm is deflectable in a direction which is perpendicular to the plane of the first contact arms.

5. The switch according to claim 1, wherein the cavity has a wall surface which is opposed to the resilient contact arm and is shaped in conformance with an exterior surface of the pin.

6. A switch comprising:

a housing which holds first and second contacts, the first contact having a pair of first contact arms which are spaced-apart on opposite sides of a pin-receiving cavity and which are aligned in a plane that is coincident with a pin-receiving axis of the cavity, the second contact having a resilient contact arm which extends into the pin-receiving receiving cavity and includes laterally extending wings which are normally engaged with respective ones of the first contact arms, the resilient contact arm being arranged to be deflected by a pin which is inserted into the cavity, wherein the second contact becomes disengaged from the first contact when the pin is installed in the cavity.

7. The switch according to claim 6, wherein the first contact is made from sheet material, and the pair of first contact arms are defined by portions of the sheet material on opposite sides of a cutout.

8. The switch according to claim 6, wherein the resilient contact arm is deflectable in a direction which is perpendicular to the plane of the first contact arms.

9. The switch according to claim 6, wherein the cavity has a wall surface which is opposed to the resilient contact arm and is shaped in conformance with an exterior surface of the pin.

* * * * *